US006155175A

United States Patent [19]

Rude et al.

[11] Patent Number: 6,155,175

[45] Date of Patent: Dec. 5, 2000

[54] RAILROAD MATERIAL CART

[75] Inventors: Robert P. Rude, East Amherst; James D. Stuart, Hamburg, both of N.Y.; Zigmunt Weglarz, N. Canton, Ohio

[73] Assignee: ERS Industries, Inc., West Seneca, N.Y.

[21] Appl. No.: 09/185,215

[22] Filed: Nov. 3, 1998

Related U.S. Application Data

[60] Provisional application No. 60/064,585, Nov. 5, 1997.

[51] Int. Cl.[7] ..... E01B 27/00

[52] U.S. Cl. ..... 104/17.1; 414/339; 414/502; 414/503; 198/533

[58] Field of Search ..... 217/174, 253; 198/533, 532; 414/339, 414, 415, 502, 503, 505, 519, 523; 104/17.1, 17.2

[56] References Cited

U.S. PATENT DOCUMENTS

| | | | |
|---|---|---|---|
| 4,131,067 | 12/1978 | Newman et al. | 104/17.1 |
| 4,694,948 | 9/1987 | Ceylan | 198/311 |
| 4,972,970 | 11/1990 | Toerner | 222/1 |
| 5,203,662 | 4/1993 | Theurer et al. | 414/339 |

*Primary Examiner*—S. Joseph Morano
*Assistant Examiner*—Frantz Jules
*Attorney, Agent, or Firm*—Hodgson, Russ, Andrews, Woods & Goodyear, LLP

[57] ABSTRACT

A railroad vibratory system having a hopper, a shaker, a conveyor assembly and a handling device that fastens railroad material to secure a railroad track onto a railroad track system. The hopper releases the railroad material, through an aperture. The shaker oscillates the hopper so the railroad material releases, controlled and orderly, through the aperture. The conveyor assembly receives the railroad material through the aperture and transports the railroad material to the handling device.

14 Claims, 16 Drawing Sheets

RAILROAD MATERIAL CART

This application claims the benefit of U.S. Provisional No. 60/064,585 filed Nov. 5, 1997.

BACKGROUND OF THE INVENTION

The present invention relates to supply vehicles, and more particularly, to material supply carts.

Presently, railroad tracks are held in place by being anchored and spiked to railroad ties, the ties rest on a bed of crushed stone. New railroad tracks are constantly being installed, and old railroad tracks are constantly being repaired, as diligent maintenance prevents undesirable derailments.

Today, machines automatically drive spikes and anchors that secure the railroad track to the railroad ties, thus greatly reducing labor costs. However, the manner the spikes and the anchors are delivered to those machines is quite problemsome. That task consumes significant time and manual labor. Although there are machines to automatically drive spikes and anchors, the spikes and anchors are typically delivered in heavy metal buckets. Railroad workers must manually carry and load the spikes or anchors from the buckets into the machine. Additionally, since these buckets are designed for manual handling, they typically carry a small supply of spikes or anchors.

There are numerous disadvantages with this manual delivery process. These disadvantages include increased injuries to the railroad workers, time wasted in opening and handling the cumbersome buckets, and time lost while the automatic spike and anchor driving machine idlely awaits for more spikes or anchors. Additionally, when the buckets are emptied, they become dangerous objects with many sharp edges being exposed where the buckets were opened, and must be promptly disposed of. Proper disposal takes additional time and expense.

The present invention provides a novel solution to the problem of delivering railroad spikes, anchors, and the like to an automatic anchor or spike driving machine.

SUMMARY OF THE INVENTION

A railroad vibratory system having a hopper, a shaker, a conveyor assembly and a handling device that fastens railroad material to secure a railroad track onto a railroad track system. The hopper releases the railroad material, through an aperture. The shaker oscillates the hopper so the railroad material releases, controlled and orderly, through the aperture. The conveyor assembly receives the railroad material through the aperture and transports the railroad material to the handling device.

DETAILED DESCRIPTION OF THE PREFERRED EMBODIMENTS

Figure 1:
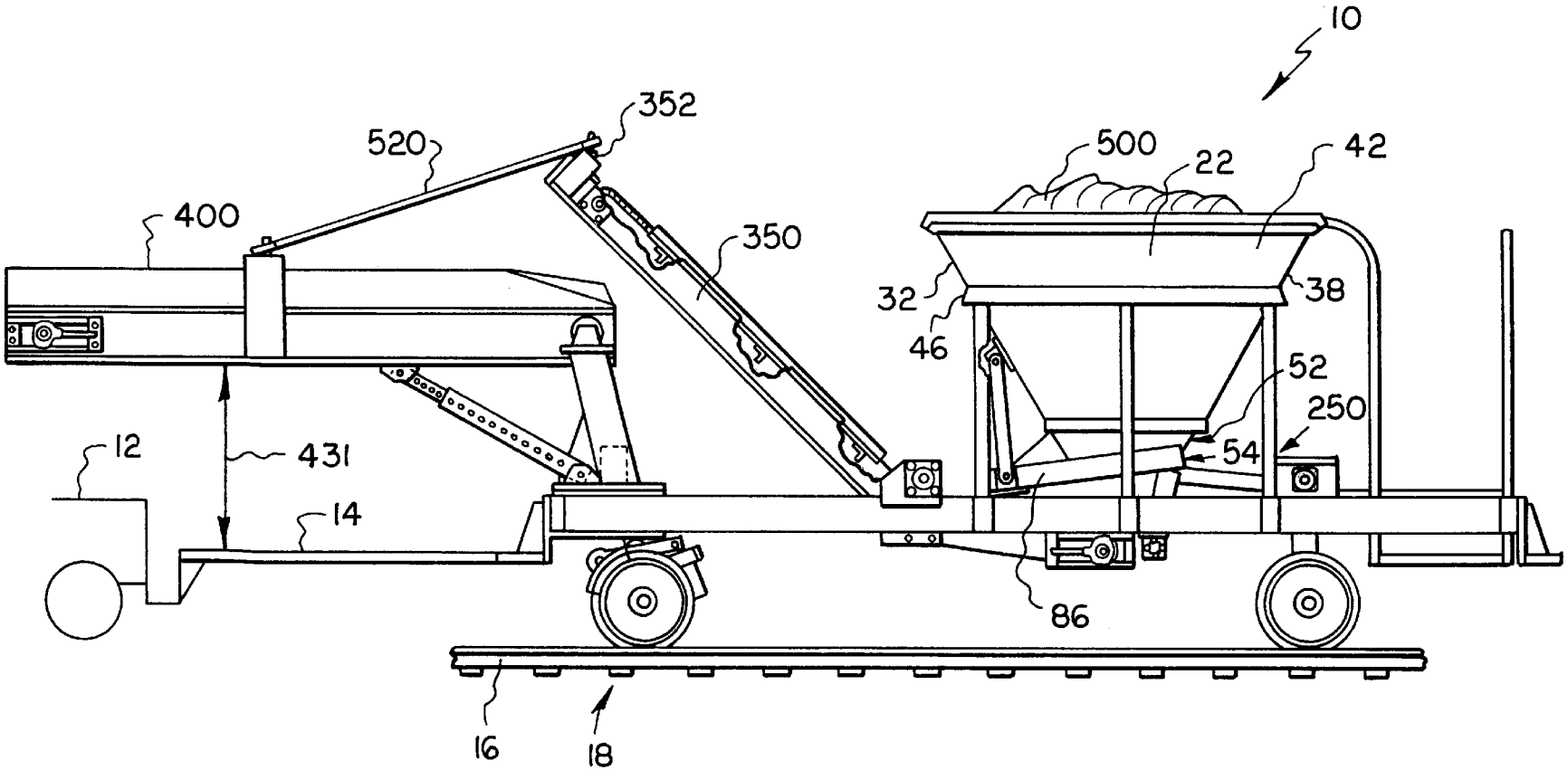
FIG. 1 is a partly schematic side elevational view of the material cart of the present invention.

Turning now to FIG. 1, shown therein is a partly schematic plan side elevational view of the present invention. Shown generally at 10 is a material cart of the present invention. A pulling train 12 pulls the material cart 10 by being hooked thereto by a tow bar assembly 14. Pulling train 12 and material cart 10 travel on a train track 16, that rests on a trackbed 18. Material cart 10 has a hopper 22 that holds a large supply of spikes and/or anchors 500. Material cart 10 is also equipped with a shaker 250 in communication with a chute 86. The shaker 250 feeds the materials 500 from hopper 22 through chute 86 onto a first conveyor assembly 350. Assembly 350 delivers the materials 500 to a second conveyor assembly 400. In turn, assembly 400 delivers materials 500 to the pulling train 12. Pulling train 12 has a handling apparatus 20 that receives the materials 500, and then drives and/or fastens the materials 500 in order to secure the train track 12 to the trackbed 18. The apparatus 20 is either an automatic spike driver, an automatic anchor fastener, or other similar device capable of handling materials 500 known to those skilled in the art capable of handling the materials 500. As pulling train 12 travels along track 16, materials 500 are constantly delivered to the handling means 20, until hopper 22 requires reloading.

Figure 2:
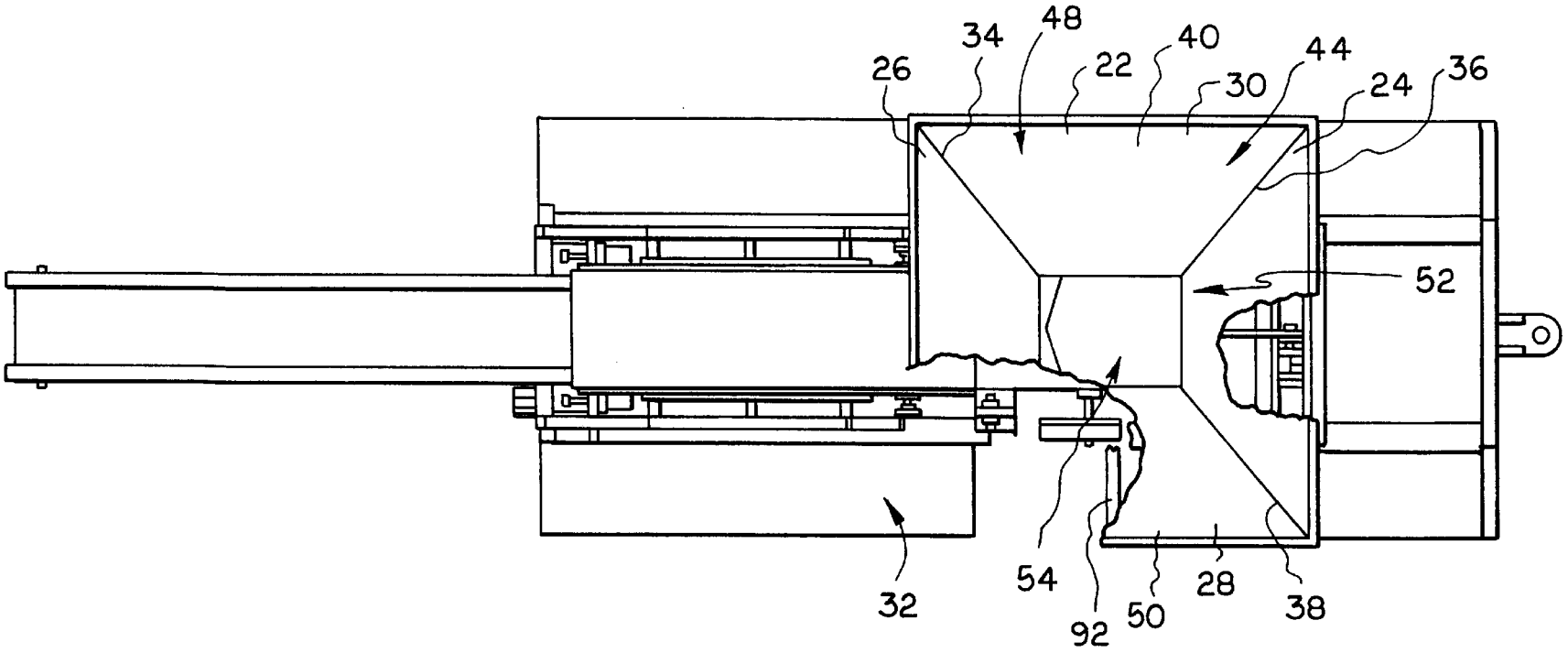
FIG. 2 is a top partly cutaway view of the present invention.
Figure 3:
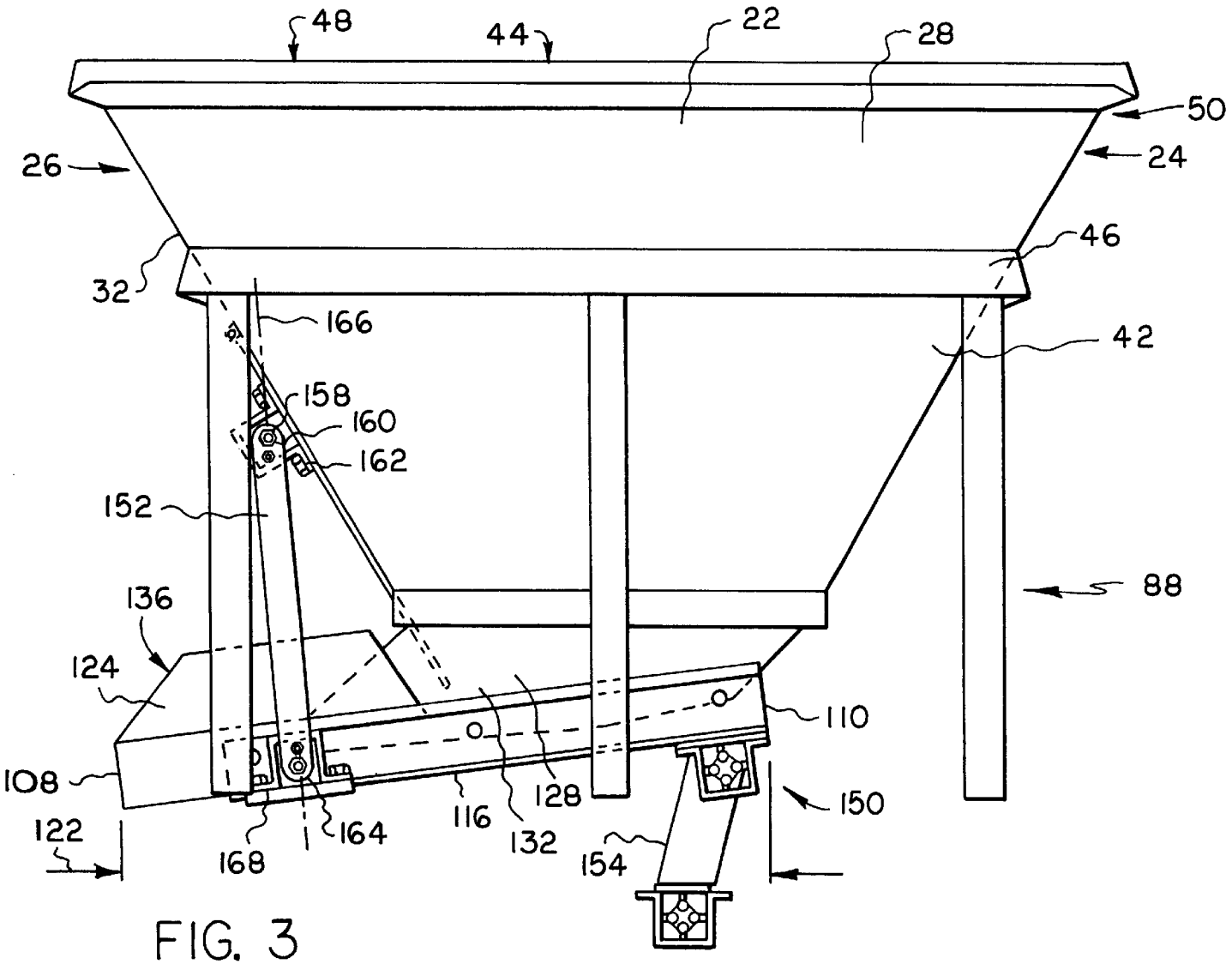
FIG. 3 is a plan side elevational view of the hopper of the present invention.

Shown in FIGS. 2 and 3, hopper 22 has a generally truncated inverted pyramid shape comprising a rear side 24 positioned opposite a discharge side 26, and a first support side 28 positioned opposite a second support side 30. All these sides 24, 26, 28, 30 are constructed of steel or other suitably durable material. Each side 24, 26, 28, 30 has a generally trapezoidal shape, and joined, i.e., by welding, along junctions 32, 34, 36, and 38, as seen in FIGS. 2 and 3. The hopper 22 has an internal surface 40 and exterior surface 42. The interior surface 40 defines the hopper interior 44.

Hopper 22 has a loading opening 48 at its distal end 50 thereof, as seen in FIG. 2. The loading opening 48 receives a charge or supply of materials 500, i.e., spikes, railroad anchors, and the like, from a supply source (not shown). Hopper 22 and loading opening 48 are sized so the interior 44 is mass loaded with materials 500 delivered from a conveyor assembly (not shown) or from a front end loader (not shown). Preferably, the interior 44 holds six or more tons of materials 500. Shown in FIGS. 1 and 2, at the proximal end 52 of hopper 22 is a discharge opening 54. Opening 54 is opposite and smaller than the loading opening 48. Materials 500 found in the interior 44 pass through discharge opening 54, in a manner fully described below.

A support channel 46 attaches to the exterior surface 42, along the discharge and rear sides 26, 24 and first and second support sides 28, 30, parallel to and between the distal and proximal ends 50 and 52. The support channel 46 prevents the hopper 22 from bulging when loaded with materials 500, and supports the hopper 22, as fully described below.

Figure 4:
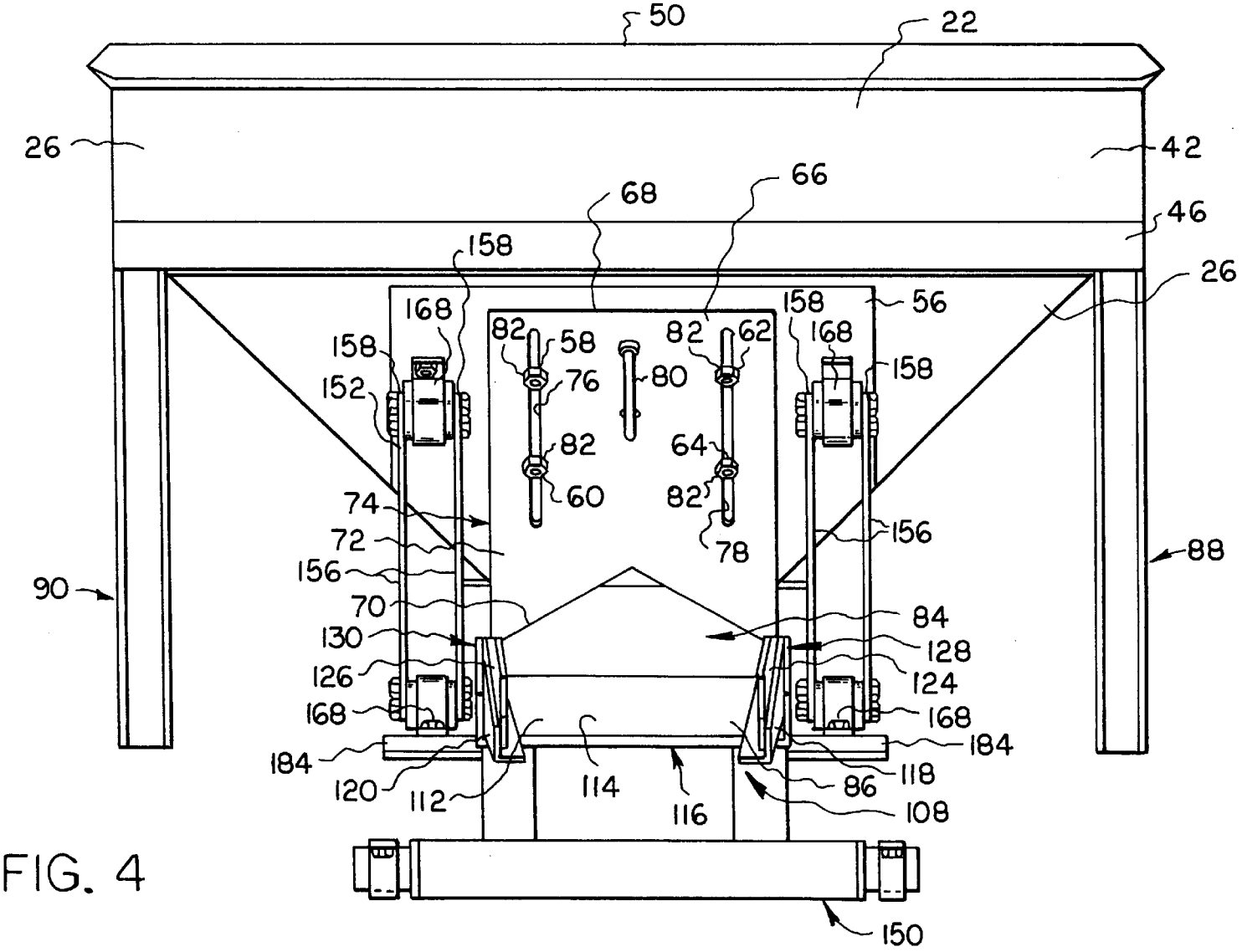
FIG. 4 is a plan elevational view of the discharge side of the hopper.

Shown in FIG. 4 on the exterior surface 42, along the discharge side 26 thereof, is a fixedly attached reinforcing plate 56, between the support channel 46 and the proximal end 52. Four adjusting bolts 58, 60, 62, and 64 extend from the reinforcing plate 56 and each adjusting bolt 58, 60, 62, and 64 fixedly attaches to the reinforcing plate 56.

A discharge gate 66, constructed of plate steel or other suitable material, adjustably positions on the exterior surface 42 on the discharge side 26 thereof. Discharge gate 66 has a first edge 68 and an oppositely positioned second edge 70. Second edge 70 is V-shaped, wherein the point of the V points toward the first edge 68. Discharge gate 66 also has an external gate surface 72 and an internal gate surface 74, and has formed therein adjusting slots 76, 78. The slots 76, 78 extend through discharge gate 66 from the external surface 72 to the internal surface 74. The adjusting slots 76, 78 are parallel to one another, and perpendicular to the first edge 68. Affixed to the external surface 72, between the adjusting slots 76, 78 and parallel thereto, is a handle 80. The handle 80 permits manual movement of the discharge gate 66, as fully described below.

Discharge gate 66 fits on the discharge side 26 when gate 66 faces the internal gate surface 74 towards the reinforcing plate 56, aligns slot 76 with adjusting bolts 58, 60, and aligns slot 78 with adjusting bolts 62, 64. The slots 76, 78 accommodate the adjusting bolts 58, 60 and 62, 64 respectively. The discharge gate 66 moves into a closely spaced relationship with the reinforcing plate 56, when the adjusting bolts 58, 60 pass through slot 76, and adjusting bolts 62, 64 pass through slot 78.

Next, nut and washer combinations 82, unfittable through slots 76, 78, affix to each adjusting bolt 58, 60, 62, and 64, so discharge gate 66 is between the nut and washer combinations 82 and the reinforcing plate 56. The discharge gate 66 moves by loosening each nut and washer combination 82, and using handle 80 to move discharge gate 66 towards or away from the distal end 50. Then, when the desired position is achieved, each nut and washer combination 82 is retightened to secure gate 66 in place.

While discharge gate 66 is being moved, the user sets the gate opening 84, in FIG. 4, to the desired size. Gate opening 84 communicates with the interior 44 and defines the distance between the second V-shaped edge 70 and the material surface 114 of chute 86. Of course, gate opening 84 is in direct proportion to the dispersal rate of the material 500 from the interior 44; the larger the opening 84 the faster the dispersal rate. The V-shaped second edge 70 deposits the materials 500 on chute 86 as the materials 500 leave hopper 22 through gate opening 84.

Figure 8:
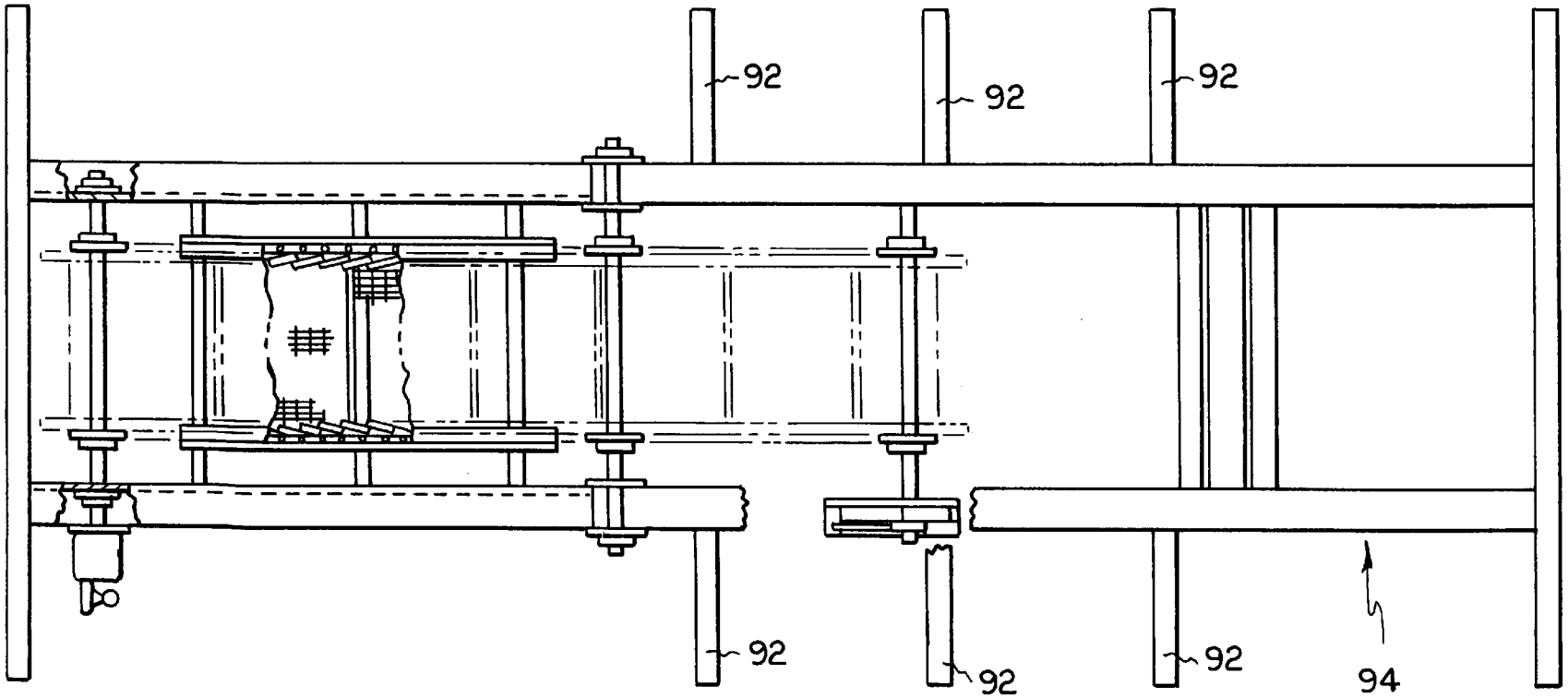
FIG. 8 is a is a plan partly cutaway view of the framework of the present invention.

A first array and second array of hopper support columns 88 and 90, best seen in FIGS. 1, 3, and 4, support the hopper 22 and materials 500. One end of each column in the first array 88 attaches to the support channel 46, in particular with the portion that attaches to the exterior surface 42 along the first support side 28. The other end of each column in the first array 88 attaches to frame members 92, seen in FIGS. 2 and 8. Likewise, one end of each column in the second array 90 attaches to the support channel 46, in particular the portion that attaches to the exterior surface 42 along the second support side 30. The other ends of each column in the second array 90 attaches to frame members 92.

Each frame member 92 extends from and attaches to a primary frame assembly 94. The primary frame assembly 94 has a first beam 96 and a second beam 98, from which the frame members 92 extend therefrom. The frame members 92 and primary frame assembly 94 are constructed of steel channel and other suitably durable materials, and welds fasten the frame members 92 to the primary frame assembly 94.

A front axle 100 and a rear axle 102 support and carry the primary frame assembly 94. A first wheel pair 104 and second wheel pair 106 that run on track 16, carry the axles 100, 102. The primary frame assembly 94 connects to the axles 100, 102, this connection is well known to those of ordinary skill in the art.

Preferably, the present invention has three individual columns in the first array 88, and three individual columns in the second array 90, as shown in the FIGS. 1 and 3. Each support column in the first and second arrays 88, 90 are constructed of steel channel, steel I-beams, or other suitable materials.

Chute 86 is located external to hopper 22, immediately adjacent to the discharge opening 54 located at the proximal end 52 thereof. Chute 86 moves material 500 from the hopper interior 44 to the first and second conveyor assemblies 350 and 400 respectively. The shaker 250, 86, moves the chute 86, supported by a pivot arm assembly 150, in a direction towards and away from the discharge opening 54. The pivot arm assembly 150 permits chute 86 to move when the shaker 250 operates. The shaker 250 disturbs the materials 500 in the interior 44 to foster a continuous gravity induced flow of the material 500 therefrom.

Chute 86, constructed of a durable material such as steel, has a mouth end 108, and a closed end 110, as shown in FIGS. 3 and 4. Chute 86 also has a ramp 112 that receives materials 500 or the chute's material surface 114, one side of the material surface 114 faces the proximal end 52. Chute 86, furthermore, has a support surface 116 opposite the material surface 114 that supports the chute 86 in conjunction with the pivot arm assembly 150. The ramp 112 tapers so the mouth end 108 is narrower than the closed end 110. This ramp configuration fosters materials 500 to move to the mouth end 108 in a more orderly fashion.

Chute 86 also has first and second chute sides 118 and 120 that extend from the material surface 114 and span the entire length of chute 86, designated 122 in FIG. 3. The chute sides 118 and 120 prevent materials 500 from falling off the material surface 114. First and second material flanges 124 and 126 extend from the material surface 114 at the mouth end 108 thereof. First and second material flanges 124 and 126 have a generally trapezoidal shape, and extend above first and second chute sides 118 and 120, as shown in FIG. 3. First and second material flanges 124 and 126 prevent materials 500 from falling off the material surface 114, and allow materials 500 to deposit on the first conveyor assembly 350 as the materials 500 leave the mouth end 108.

First hopper flange 128 and second hopper flange 130 extend from the first and second support sides 28 and 30 at the proximal end 52, and are mounted thereto. The first and second hopper flanges 128 and 130 are positioned such that their external surfaces 132 and 134 are closely spaced with the interior surfaces 136 and 138 of the material flanges 124 and 126. The flanges 128 and 130 in conjunction with the flanges 124 and 126 direct the flow of materials 500 onto chute 86.

The pivot arm assembly 150 moves the chute 86 and any materials 500 found on the material surface 114 thereof. Pivot arm assembly 150 has a first arm assembly 152 located adjacent to the discharge side 26, and a second arm assembly 154 located adjacent to the rear side 24, as seen in FIGS. 3 and 4.

As seen in FIG. 4, the first arm assembly 152 has four sway bars 156 constructed of steel and have a generally rectangular shape with rounded corners. At each end (proximal ends 158 and distal ends 164) of each sway bar 156, there are first pin openings 160 and second pin openings 162 of lesser diameter than the first pin openings 160. The first and second pin openings 160 and 162 align on a central axis 166, in FIG. 3. The central axis 166 follows from the proximal end 158 to the distal ends 164 of the sway bars 156. In other words, from the proximal end 158 the first pin opening 160 would be first encountered, then the second pin opening 162 would be encountered, and then the second pin opening 162 would again be encountered, and finally the first pin opening 160 would be encountered at the distal end 164.

The sway bars 156 pivot about mounts 168 at the distal and proximal ends 164 and 158. Each mount 168 has a mounting bracket 170, and each bracket 170 has a grommet opening 172 and a rubber grommet 174. The rubber grommet 174 fits into the grommet opening 172 in a closely spaced relationship. Each rubber grommet 174 has a first pin hole 176 and a second pin hole 178 of lesser diameter than the first pin hole 176.

The proximal ends 158 of the sway bars 156 suspend from the reinforcing plate 56 on the discharge side 26 by mounts 168. Two mounts 168 fasten to the reinforcing plate 56, on opposite sides of discharge gate 66, as seen in FIG. 4. The proximal ends 158 of two bars 156 are positioned on opposite sides of each mount 168, and the first pin openings 160 align with the first pin hole 176 in rubber grommet 174, and the second pin openings 162 align with the second pin holes 178 in the rubber grommets 174. Next, while this alignment is maintained, a first pivot pin 180 inserts into the first pin opening 160 at the proximal end 158 of one sway bar 156, through the first pin hole 176, and through the first pin opening 160 at the proximal end 158 of another sway bar 158. The first pivot pin 180 bolts at either end thereof to secure it in place. The second pivot pin 182 positions itself into the second pin opening 162 of one sway bar 158, through the second pin hole 178, and through the second pin opening 162 in another sway bar. The second pivot pin 182 bolts at either end thereof to secure it in place. This process is repeated to attach the remaining two sway bars 156 to the other mount affixed to reinforcing plate 56. The result of this attaching process is that each mount 168 attached to the reinforcing plate 56 sandwiches between sway bars 156 that are pivotally affixed thereto and suspended therefrom.

Next, the remaining two mounts 168 attach to the mount support 184 that is affixed to the support surface 116 of the ramp portion 112. The distal ends 164 align with the mounts 168, exactly as fully described above, so the first pin openings 160 align with the first pin hole 176, and the second pin openings 162 align with the second pin hole 178. The first and second pivot pins 180 and 182 insert therein, and fasten at both ends to lock them in place. Thus, each of the two mounts 168 affixed to the mount support 184 sandwiches between the distal ends 164 of the sway bars 156. The first arm assembly 152 supports the mouthend 108 and the end 108 is swingable and movable.

Figure 4A:
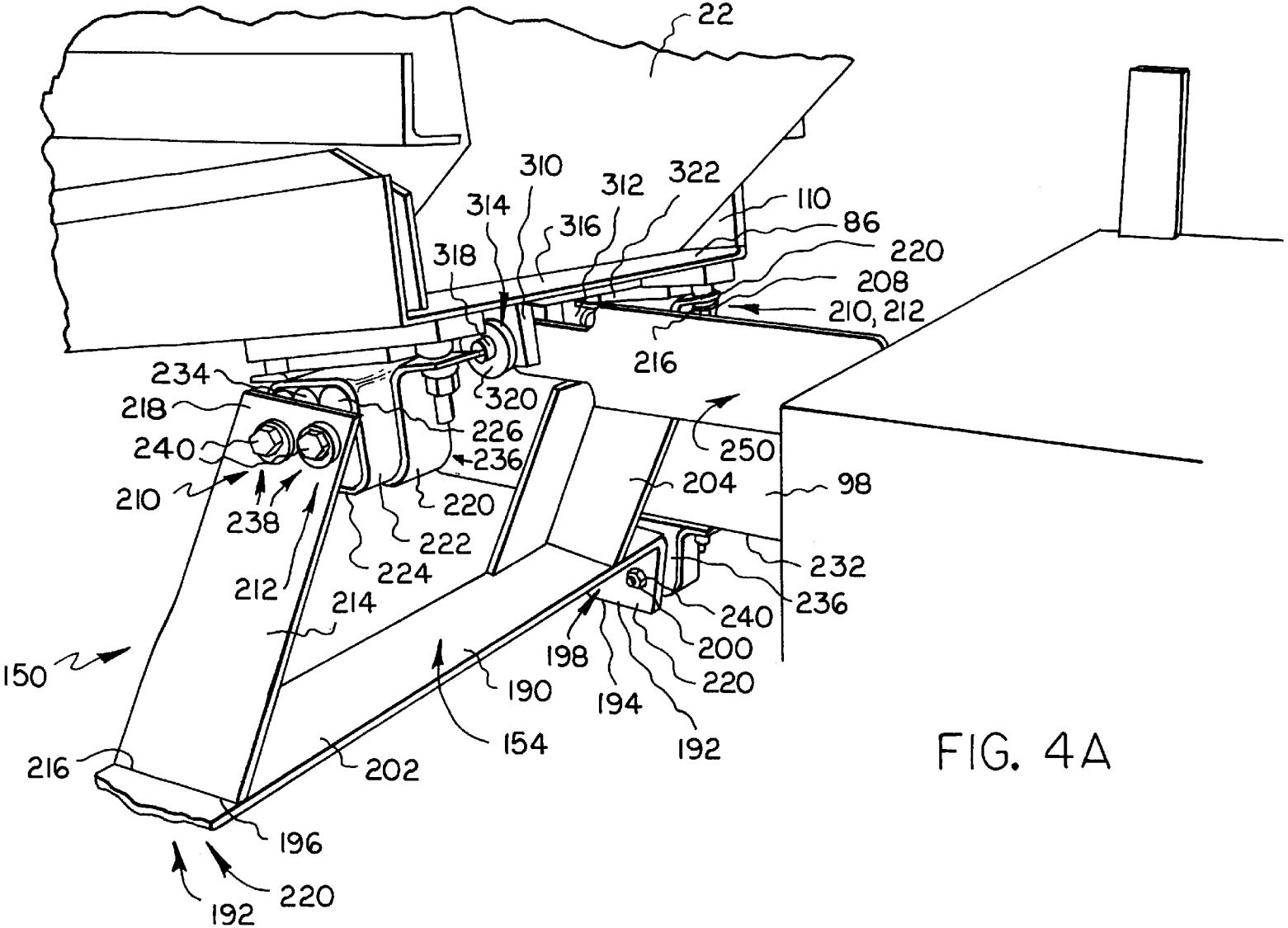
FIG. 4A is a perspective view of the chute and pivot arm assembly of the present invention.

The second arm assembly 154 of the pivot arm assembly 150, seen in FIG. 4A, supports the closed end 110 of chute 86. Second arm assembly 154 has a horizontal member 190 having an extension 192 at each distal and proximal ends 194 and 196. Each extension 192 has two pivot pin throughbores 198 and 200 extending completely therethrough. The second arm assembly 154 also has a first pillar 204 and a second pillar 214. The first pillar 204 extends from the load bearing surface 202 of the horizontal member 190 at the distal end 194 thereof; and the second pillar 214 extends from the load bearing surface 202 at the proximal end 196 thereof. The first end 206 of the first pillar 204 attaches to the load bearing surface 202, and the second end 208 of first pillar 204 has two pin throughbores 210 and 212 respectively, extending completely therethrough. Similarly, the first end 216 of the second pillar 214 attaches to the load bearing surface 202 at the proximal end 196 thereof. At the second end 218 of the second pillar 214 are two pin throughbores 210 and 212, in a location identical to the two pin throughbores 210 and 212 in the first pillar 204.

Four rocking mounts 220 support the second arm assembly 154. Each rocking mount 220 has a brace 222, the brace 222 has a rocking grommet throughbore 224, into which is placed in a closely spaced relationship a rubber rocking grommet 226. The rubber rocking grommet 226 defines pivot pin openings 228. Two of the rocking mounts 220 affix to the support surface 116 of the ramp portion 112, at the closed end 110 thereof, and one of the mounts 220 affixes to the bottom 230 of first beam 96, and the last of the rocking mounts 220 affixes to the bottom 232 of the second beam 98. The braces 222 are welded, bolted, or otherwise suitably fastened to the positions defined above, to ensure their stability.

The rocking mounts 220 connect to the second arm assembly 154 by aligning the throughbores 210, 212 at the first ends 208, 218 of the first and second pillars 204, 214 respectively with the exterior surfaces 234 of the two rocking mounts 220 mounted on the support surface 116 of the ramp portion 112. Next, brace bolts 238 insert into the throughbores 210, 212 at the first ends 216, 218 of the first and second pillars 204, 214, and then through the pivot pin openings 228 in the rubber rocking grommets 224. The brace bolt nuts and washers 240 affix to the brace bolts 238 locking them in place. Next, the throughbores 198, 200 in the extensions 192 of the horizontal member 190 align with the interior surface 236 of the rocking mounts 220 mounted on the bottom 230 of the first beam 96 and bottom 232 of the second beam 98. Brace pin bolts 238 insert into each throughbores 198, 200, and through the pivot pin openings 228 in the rubber rocking grommets 224. Brace bolt nuts and washers 240 affix to each brace bolt 238 to secure each in place. Thus, pivot arm assembly 150 supports chute 86, which permits the chute 86 to be oscillated or otherwise shaken.

Figure 5:
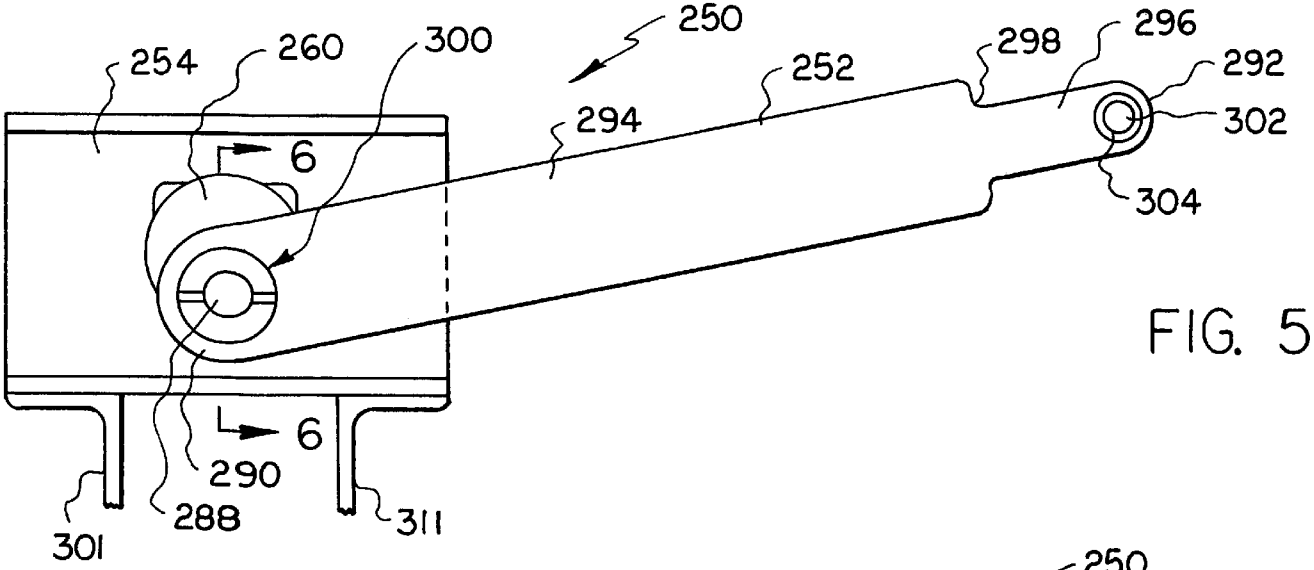
FIG. 5 is a plan elevational view of the shaker means.
Figure 6:
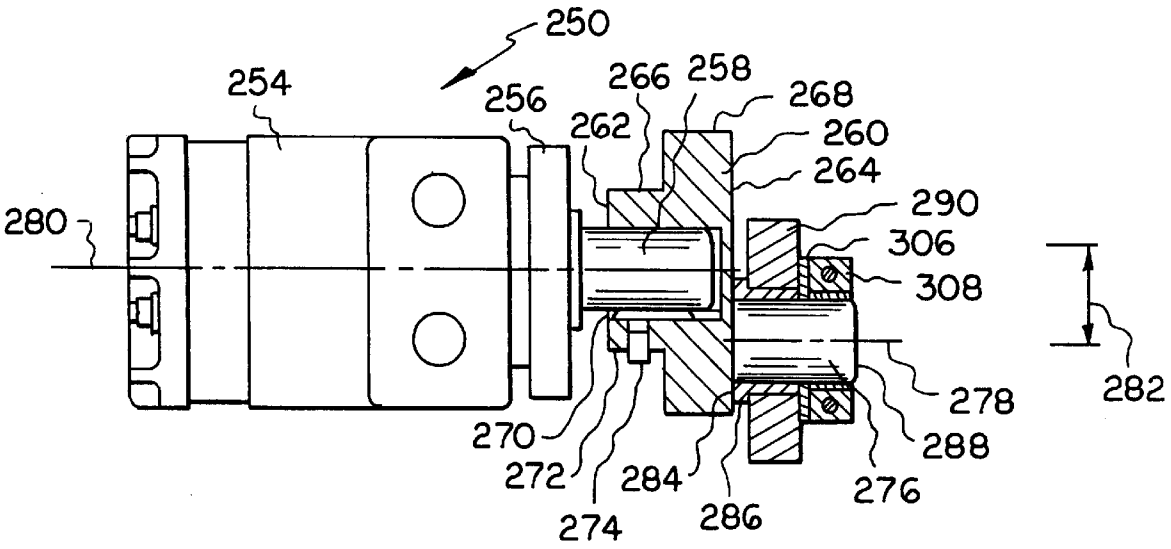
FIG. 6 is a cross-sectional view of the shaker means taken along line 6—6 show in FIG. 5.

Seen in FIGS. 4A, 5 and 6 is the shaker 250. Shaker 250, as fully described below, controls the oscillation of the chute 86. The oscillation is possibly due to the pivot arm assembly 150 that supports chute 86. Shown in FIGS. 5 and 6, is the shaker 250, that has a thrust arm 252 and a rotating device 254. The rotating device 254 is a hydraulic or electric motor, or a gas engine, or other suitable device known to those skilled in the art.

As shown in FIG. 6, the rotating device 254, at the proximal end 256 thereof, extends perpendicularly therefrom drive shaft 258. Drive shaft 258 mounts in rotating device 254 by procedures well known to those skilled in the art. Attached to drive shaft 258 is a rotating member 260. Rotating member 260 has a first side 262 and a second side 264, wherein the first side 262 is adjacent to a first cylindrical section 266, and the second side 264 is adjacent to a second cylindrical section 268 thereof. The second cylindrical section 268 has a greater diameter than the first cylindrical section 266. Rotating member 260 also has a drive shaft opening 270 formed therein, that extends through the first side 262, completely through the first cylindrical section 266, and partly through the second cylindrical section 268. Rotating member 260 also has a locking pin opening 272 extending completely through first cylindrical section 266 to the drive shaft opening 270. Drive shaft opening 270 is sized so as to form a close fitting type relationship with the drive shaft 258 when the drive shaft 258 is received therein.

The rotating member 260 affixes to the drive shaft 258 by placing the drive shaft 258 within the drive shaft opening 270, and inserting and securing locking pin 274 into locking pin opening 272. This secures drive shaft 258 to rotating member 260, such that for every one revolution of drive shaft 258, rotating member 260 makes one revolution as well.

An offset shaft 276 mounts to the second side 264 of rotating member 260. The offset shaft 276 has its centerline, designated 278 in FIG. 6, spaced apart from the centerline, designated 280 in FIG. 6, of drive shaft 258 by an offset length, designated 282 in FIG. 6. Since the offset shaft 276 mounts to the rotating member 260, it makes one revolution for every revolution of the rotating member 260. Shown in FIG. 6, the offset shaft 276, that has a proximal end 284 and opposite thereto a distal end 288, fits about its proximal end 284 bearing 286.

Thrust arm 252 has a first end 290 and a second end 292, seen in FIG. 5. Thrust arm 252 has a generally rectangular region 294, that meets with a narrowed region 296 at taper 298. A first pivot opening 300 is formed in the rectangular region 294 at the first end 290 of the thrust arm 250, and a second pivot opening 302 is formed in the narrowed region 296 at the second end 292 of thrust arm 252. At the second pivot opening 302 found internally affixed therein is chute bearing 304. Thrust arm 252 is constructed of plate steel, or any other suitably durable material.

As seen in FIGS. 5 and 6, the first pivot opening 300 in thrust arm 252 fits over the bearing 286, and surrounds the offset shaft 276. A washer 306 is found between the first end 290 of thrust arm 252, and a locking nut 308. The locking nut 308 attaches to the distal end 288 of the offset shaft 276. The locking nut 308 holds the first end 290 of the thrust arm on the bearing 286. In this setup, the rotating member 260 rotates, which in turn causes the offset shaft 276 to rotate, which causes the movement of the first end 290 of thrust arm 258.

Shown in FIGS. 1 and 4A, the rotating device 254 mounts on channels 309 and 311, that in turn attach to the first and second beams 96 and 98 of the primary frame assembly 94. As seen in FIG. 4A, the second end 292 of thrust arm 258 pivots on the support surface 116 of the ramp portion 112, at the closed end 110 thereof. Two thrust braces 310 and 312 attach and extend from the support surface 115 of the ramp portion 112. Each thrust brace 310, 312 extends through thrust pin throughbores 314, 316. The second pivot opening 302 of thrust arm 252 aligns with the thrust pin throughbores 314, 316, and thrust pin 318 inserts therethrough, and fastened at both ends thereof by fasteners 320, 322, that locks thrust pin 318 in place.

Figure 7:
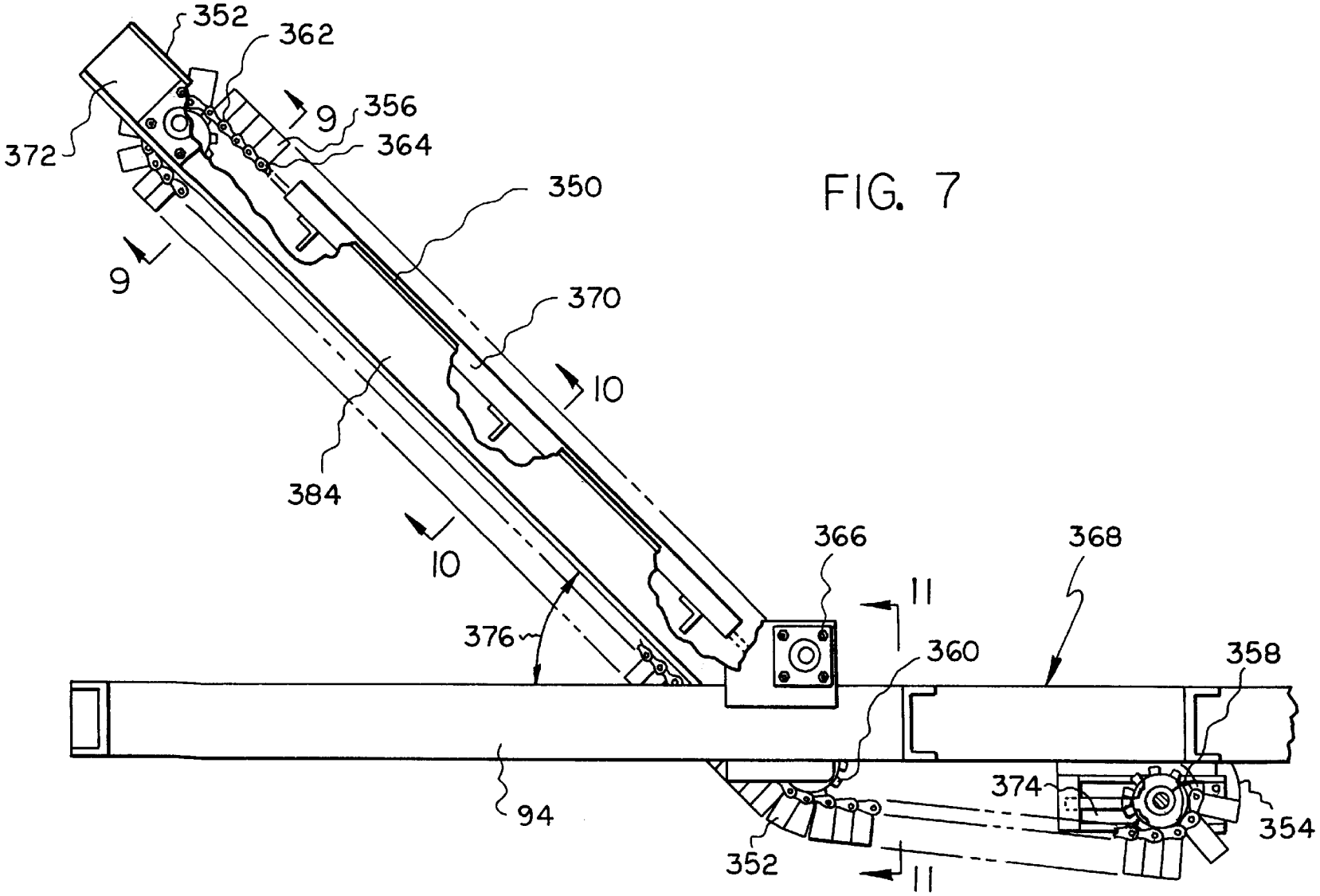
FIG. 7 is a plan elevational view of the first conveyor assembly.

As seen in FIGS. 1 and 7, first conveyor assembly 350 has a distal end 352, a proximal end 354, and a conveyor belt 356, preferably, constructed of steel or other suitably durable material. It further has a first sprocket assembly 358 at the proximal end 354, a second sprocket assembly 360, and a third sprocket assembly 362 at the distal end 352. The sprocket assemblies 358, 360, 362 communicate with the drive chain assembly 364 that carries belt 356. An upturn shaft 366, positioned between the chute portion 368 and elevated portion 370 of the first conveyor assembly 350, permits the conveyor belt 356 to bend as it travels from the chute portion 368 and the elevated portion 370 along the conveyor assembly 350. The elevated portion 370 elevates from the chute portion 368 at a predetermined angle, designated 376 in FIG. 7. That angle is between the primary frame assembly 94 and the elevated portion 370 of the first conveyor assembly 350.

The conveyor belt 356 moves by the motor 372. The motor 327 is in torquing communication with the third sprocket 362. As such, the third sprocket 362 turns in a counterclockwise direction as per the side elevational view of FIG. 7. The motor 372 is a hydraulic, electric, or any other suitable motor for generating torque. Motor 372 affixes to head shaft 378.

In communication with the first sprocket 358 is the take up device 374. The take up device, in communication with the conveyor belt 356, adjusts the tension in conveyor belt 356 so the tension is properly set. When the tension is proper, the drive chain 364 does not leave first, second, and third sprocket assemblies 358, 360, 362.

Figure 9:
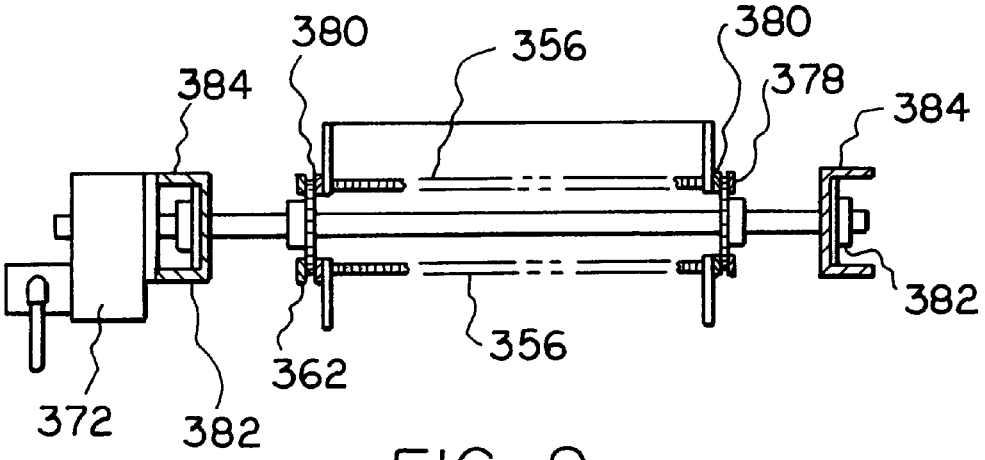
FIG. 9 is a cross-sectional view of the first conveyor assembly taken along line 9—9 of FIG. 7.

Seen in FIG. 9 is a cross-sectional view of the first conveyor assembly 350 taken along line 9—9 in FIG. 7. Seen therein is the third sprocket assembly 362. The assembly 360 has a head shaft 378, sprocket 380, and the conveyor flange bearings 382 that rotatably connect the head shaft 378 to the conveyor flanges 384. Conveyor belt 356 is also seen in FIG. 7.

Figure 10:
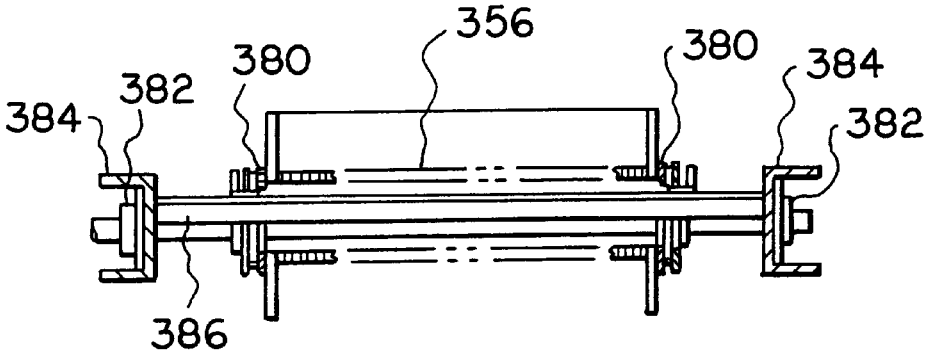
FIG. 10 is a cross-sectional view of the first conveyor assembly taken along line 10—10 of FIG. 7.

Turning to FIG. 10, cross-sectional view of the elevated portion 370 of the first conveyor assembly 350, taken along line 10—10 of FIG. 7 is shown. Intermediate shaft 386 affixes to conveyor flanges 384 by the conveyor flange bearings 382. This shaft 386 has sprockets 380 attached thereto for guiding drive chain 364.

Figure 11:
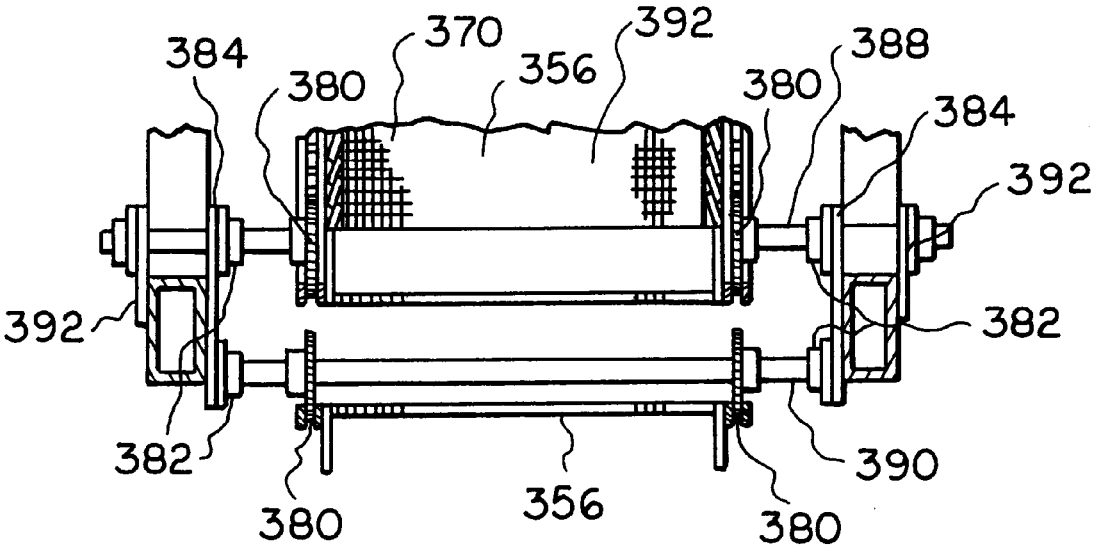
FIG. 11 is a cross-sectional view of the first conveyor assembly taken along line 11—11 of FIG. 7.

As seen in FIG. 11, a cross-sectional view of the first conveyor assembly 350 taken along line 11—11 of FIG. 7 is illustrated. The first and second turning shafts, 388, 390 attach to the conveyor flanges 384 by the conveyor flange bearings 382. Sprockets 180 guide the drive chain 364, and ensure the chain 364 moves in a controlled manner. Finally, transportation surface 392 of the conveyor belt 356 is seen at the elevated portion 370 of the first conveyor assembly 350.

Figure 12:
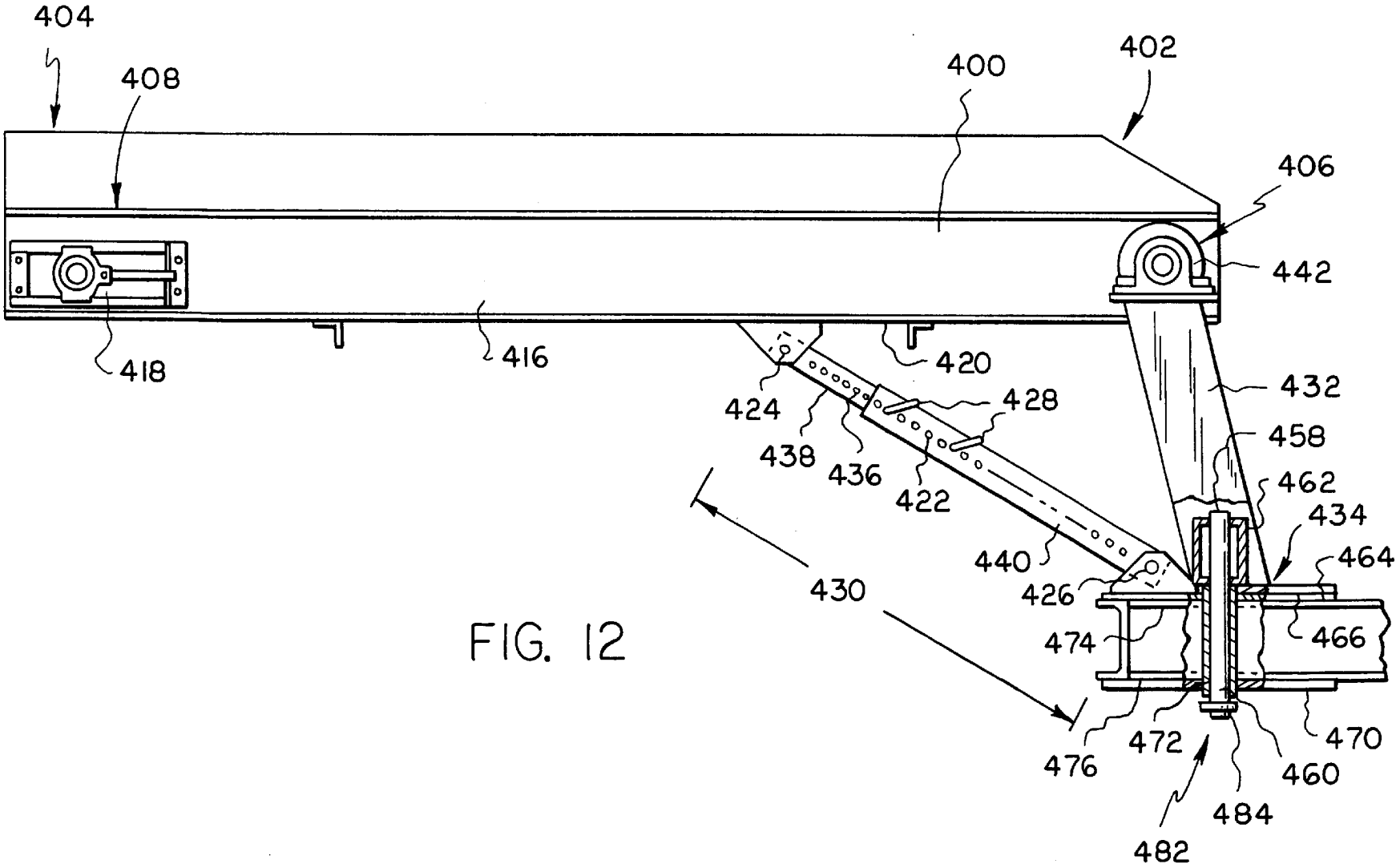
FIG. 12 is a plan elevational view of the second conveyor assembly of the present invention.
Figure 13:
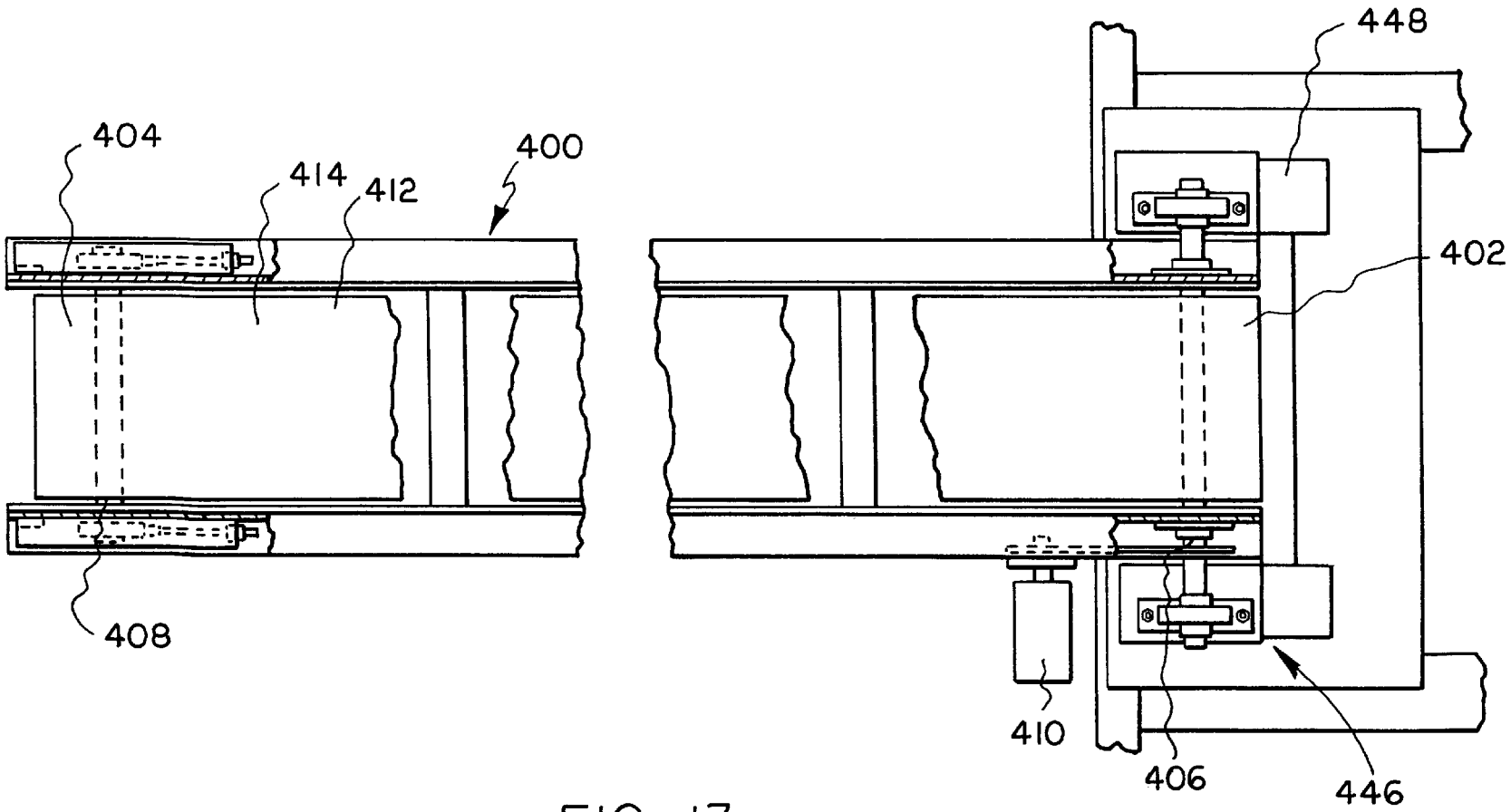
FIG. 13 is a top partly cutaway view of the second conveyor assembly.

Seen in FIG. 12 is a side-elevational view of the second conveyor assembly 400, and seen in FIG. 13 is a top view thereof. At the proximal end 402 of the second conveyor assembly 400 is the first sprocket assembly 406, and at the distal end 404 is the second sprocket assembly 408, seen in FIG. 13. The motor 410, an electric, hydraulic or fuel motor, is in torquing communication with the first sprocket assembly 406. As such, the first sprocket assembly 406 turns in a counterclockwise direction when viewed from the side shown in FIG. 12. This turning causes the transportation surface 412 of the conveyor belt 414 to move towards the distal end 404 of the second conveyor assembly 400. The take up device 418 affixes on the conveyor housing 416, and is in communication with the conveyor belt 414. That communication allows the tension in the conveyor belt 414 to be adjusted. Setting the tension in conveyor belt 414 ensures the belt 414 moves in relation to the first and second sprocket assemblies 406, 408.

Two telescoping tubes 422, and first and second turret arms 446, 448 support the second conveyor assembly 400. Each telescoping tube 422 is identical, and each affixes at one end thereof to the support side 420 of the conveyor housing 416, by a first tube pin 424, and at the other end thereof to the turret assembly 434, by a second tube pin 426. Each telescoping tube 422 has a plurality of adjusting pin openings 436, into which are fittable adjusting pins 428. The telescoping tubes 422 also has a male member 438 and female member 440. The male member 438 fits into the female member 440. The length, designated 430 in FIG. 12, of each telescoping tube 422 is adjustable by first removing the adjusting pins 428 from the adjusting pin openings 436, moving the male member 438 into or out of the female member 440, and then reinserting the adjusting pins 428 into the adjusting pin openings 436 when the desired length 430 is achieved. If length 430 is increased, the result will be that the distal end 404 of the second conveyor assembly will be raised, such that its distance from track 16, designation 431 in FIG. 1, increases.

The distal end 450 of the first turret arm 446 and the distal end 452 of the second turret arm 448 pivotally attach to the conveyor housing 416 at the proximal end 402 of the second conveyor assembly 400. This pivotal mounting permits the movement of the second conveyor assembly 400 when the telescoping tubes 422 are adjusted as described above. The proximal end 454 of first turret arm 446 and the proximal end 456 of the second turret arm 448 attach to the turret assembly 434.

Turret assembly 434 has a support plate 468 mounted to the first and second turret arms 446 and 448 and telescoping tubes 422. Support plate 468 mounts on the turret bearing 464, and turret bearing 464 mounts on a first cross member 474 that spans from the first beam 96 to the second beam 98 of the primary frame assembly 94. The procedure for mounting and affixing the turret bearing 464 is well known to those skilled in the art. A second cross 476 member spans from the first beam 96 to the second beam 98 of the primary frame assembly 94, as seen in FIG. 12. A turret pin throughbore 478 extends through the rectangular tubing 468 (that affixes to the turret plate 466 between first and second turret arms 446, 448); the turret plate 466; the turret bearing 464; the first cross member 474; and the second cross member 476. A turret pin pipe 472 extends through the turret pin throughbore 478, and is in a closely spaced relationship with the turret pin throughbore 478 at the turret plate 466, the first and second cross members 474 and 476, and the turret bearing 464. The turret pin 460 inserts into the turret pin pipe 472 and through the turret pin throughbore 478 extending through the rectangular tubing 468. The turret pin 460 is held in position by an enlarged portion 486 at its proximal end 480 and a locking nut and washer 484 at its distal end 482.

Turret assembly 434 permits the entire second conveyor assembly 400 and associated telescoping tubes 422 and first and second turret arms 446, 448 to be rotated about the rotation axis, designated 458 in FIG. 12. This rotational movement permits the second conveyor assembly to rotate and controllably select the location where materials 500 discharge from the distal end 404 of the second conveyor assembly 400.

For example, hopper 22 contains a supply of materials 500 and the job requires the materials in hopper 22 be emptied, or the job is completed and hopper 22 needs to be emptied, the operator rotates the turret assembly 434 so the second conveyor assembly 400 is oriented perpendicular to track 16, and the distal end 404 thereof is positioned over a bin (not shown), truck (not shown) or other suitable container (not shown) to hold the materials 500 as they are delivered from the second conveyor assembly 400. In this way, the present invention permits the hopper 22 to be quickly and cleanly evacuated of materials 500.

Figure 16:
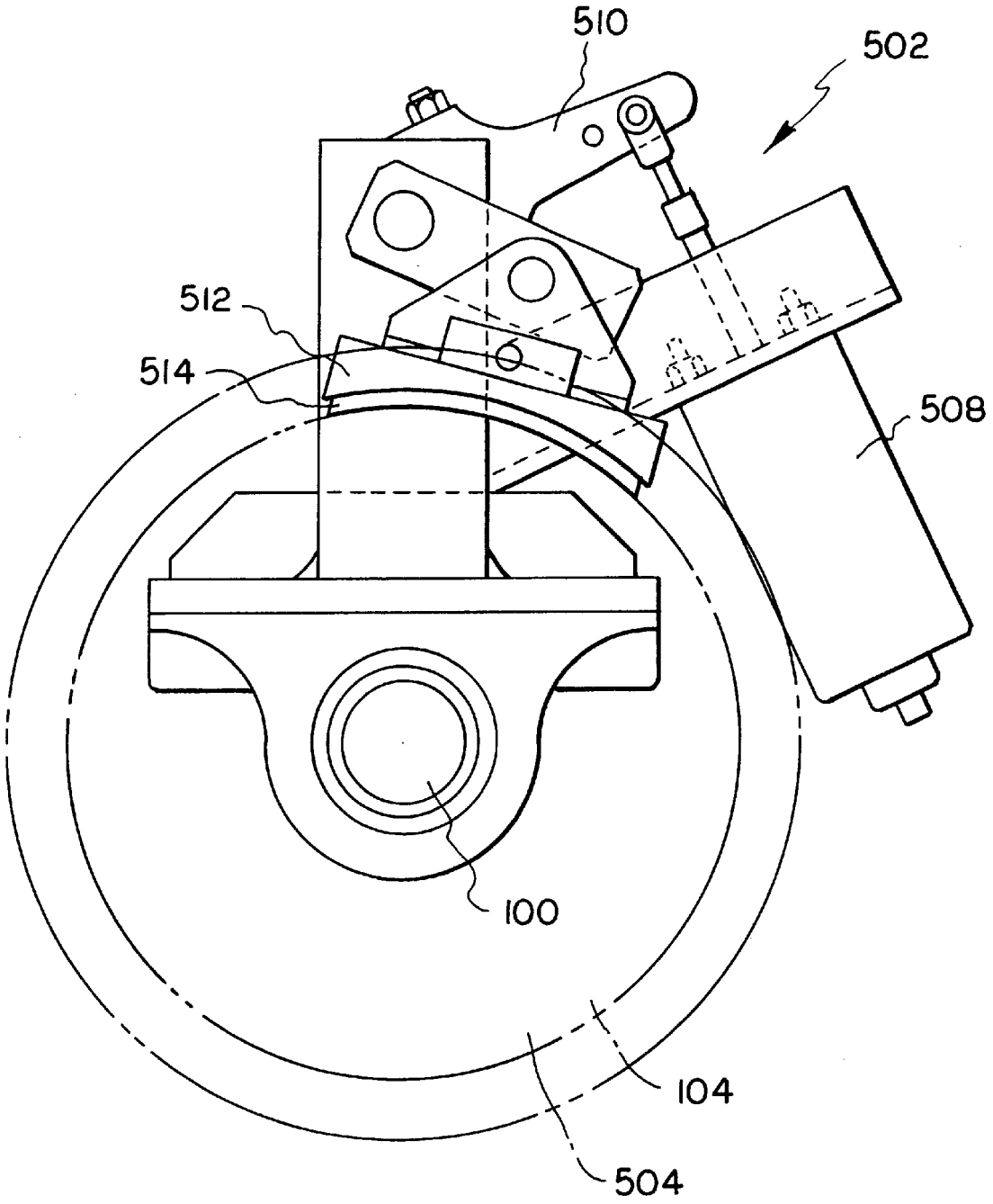
FIG. 16 is a plan elevational view of the brake assembly of the present invention.
Figure 17:
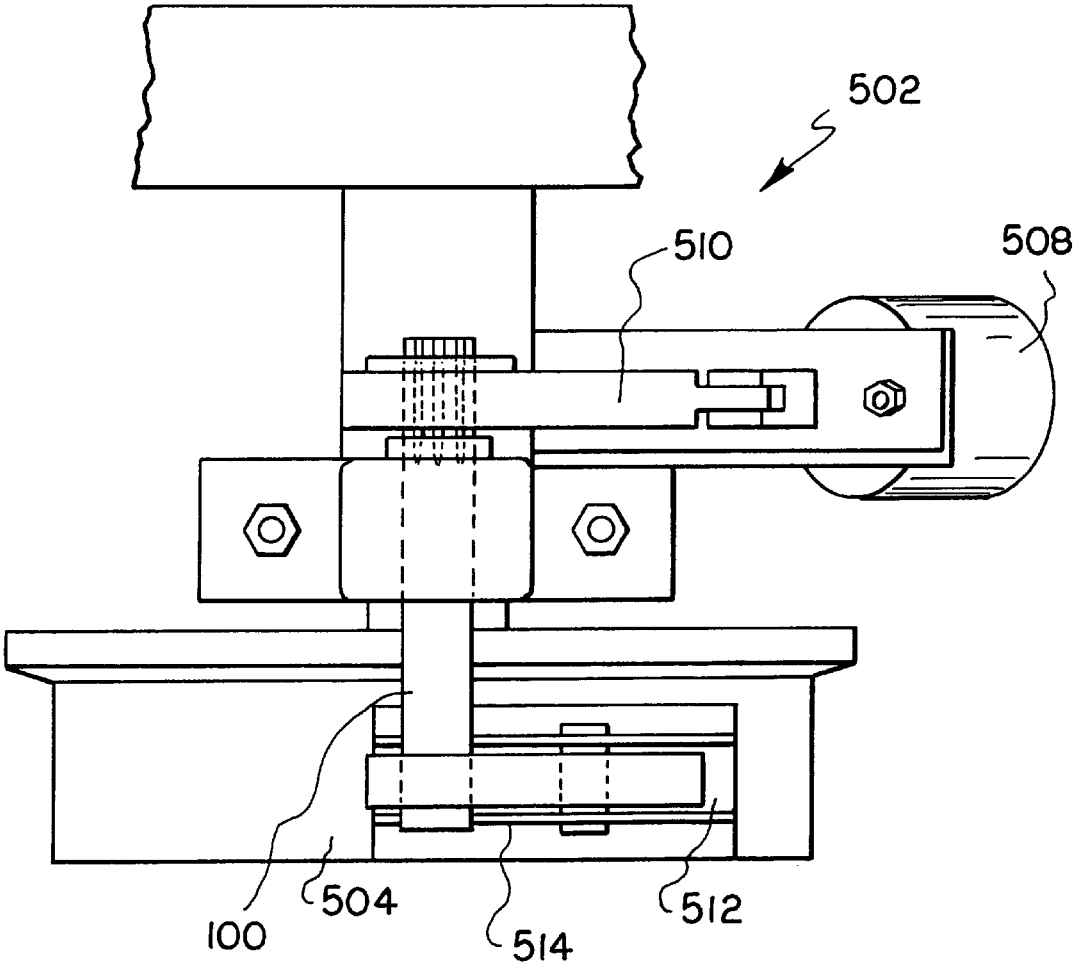
FIG. 17 is a top view of the brake assembly of the present invention.

Shown in FIG. 16 is a brake assembly 502 in communication with one of the steel wheels 504 of the first wheel pair 104 joined by the front axle 100. Hydraulic brake cylinder 508 communicates with a brake shoe 512 and a brake pad 514 by way of a lever 510. The mounting and functioning of such brake assemblies is well known to those skilled in the art. Shown in FIG. 17 is a top plan view of the brake assembly 502.

Figure 14:
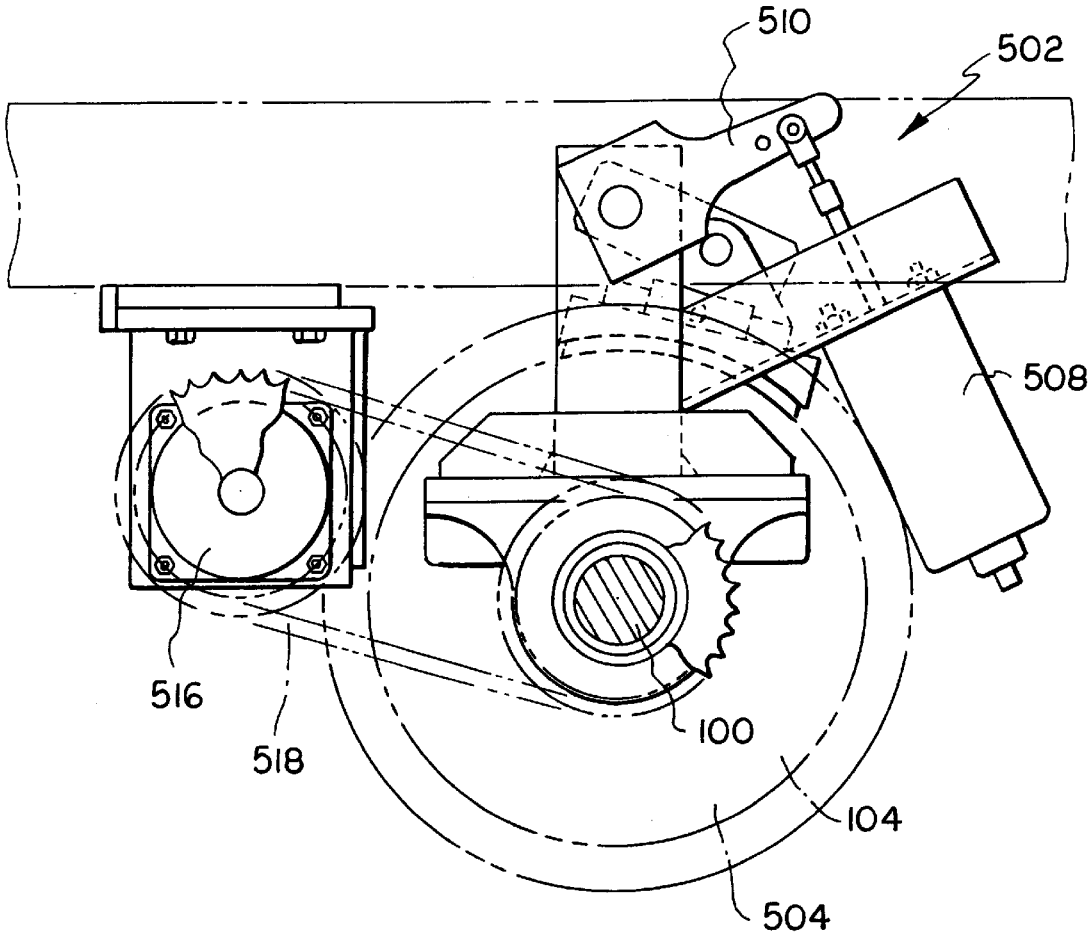
FIG. 14 is a plan elevational view of the brake assembly reverse hydraulic motor of the present invention.
Figure 15:
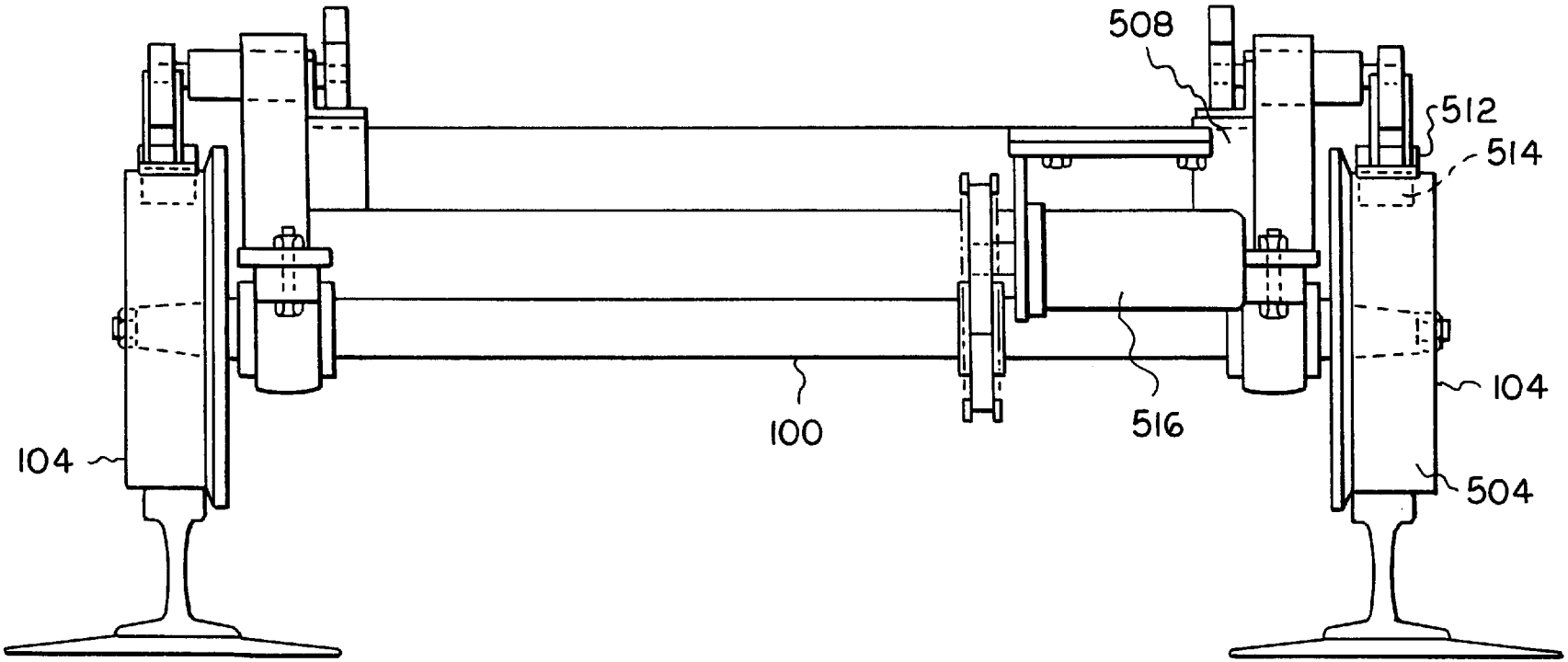
FIG. 15 is a plan view of the wheel and bearing assembly.

Shown in FIGS. 14 and 15 are views of the reverse hydraulic motor 516 mounted on the primary frame assembly 96. The reverse hydraulic motor 516 communicates with the front axle 100 by a drive belt 518, and also is in hydraulic communication with a hydraulic cylinder 508. The reverse hydraulic motor 516 for providing hydraulic flow to and actuating the hydraulic cylinder 508 in the event the material cart 10 begins to undesirably roll out of control. Such reverse hydraulic motors 516 are well known to those skilled in the art for stopping undesirable rolling.

It is intended that the above description of the preferred embodiments of the structure of the present invention and description of its operation are but one or two enabling best mode embodiments for implementing the invention. Other modification and variations are likely to be conceived of by those skilled in the art upon reading of the preferred embodiments and a consideration of the appended claims and drawings. These modifications and variations still fall within the breadth and scope of the disclosure of the present invention.

We claim:

1. A railroad vibration system comprising a hopper interconnected to a chute and being equipped to release at least one railroad material through an adjustable aperture;

a shaker that controllably oscillates the chute so the at least one railroad material releases, controllably and orderly, through the adjustable aperture; and a conveyor assembly that receives the at least one railroad material through the adjustable aperture and transports the at least one railroad material to a handling device.

2. The system of claim 1, wherein the at least one railroad material is selected from the group consisting of spikes, anchors, and combinations thereof.

3. The system of claim 1, further comprising a tow-bar assembly between the pulling train and the material cart.

4. The system of claim 1, wherein the material cart comprises at least a set of wheels that allow the material cart to move on railroad tracks.

5. A method of using a vibratory system comprising of the steps of:

oscillating a chute equipped to release at least one railroad material through an adjustable aperture by a shaker that ensures the at least one railroad material is controllably and orderly released from the adjustable aperture;

receiving the at least one railroad material through the adjustable aperture onto a conveyor assembly; and delivering the at least one railroad material by the conveyor assembly to a handling device.

6. The method of claim 5, further comprising the step of loading the chute with railroad material by a loading mechanism.

7. The method of claim 5, further comprising the step of pivoting the conveyor assembly to a loading mechanism and releasing the railroad material through the aperture onto the conveyor assembly into the loading mechanism.

8. The method of claim 5, wherein the railroad material is selected from the group consisting of anchors, spikes and combinations thereof.

9. A railroad vibration system comprising:

a hopper interconnected to a chute and designed to release at least one railroad material through an aperture;

a shaker interconnected to the chute by a thrust arm that vibrates the chute back and forth and a rotary drive that vibrates the chute in a circular motion, wherein the at least one railroad material is re-distributed to ensure passage through the aperture.

10. The system of claim 9, wherein the at least one railroad material is selected from the group consisting of spikes, anchors, and combinations thereof.

11. The system of claim 9, further comprising a pulling train that comprises a handling device; a material cart that comprises the hopper and shaker; wherein the conveyor system interconnects the hopper to the handling device.

12. The system of claim 9, wherein the aperture is adjustable.

13. The system of claim 11, further comprising a tow-bar assembly between a pulling train and a material cart.

14. The system of claim 13, wherein the material cart comprises at least a set of wheels that allow the material cart to move on railroad tracks.

* * * * *